United States Patent [19]

Richards

[11] 4,277,842

[45] Jul. 7, 1981

[54] PROTECTIVE WATCH COVER

[76] Inventor: M. David Richards, 1109 E.Date, Brea, Calif. 92621

[21] Appl. No.: 96,917

[22] Filed: Nov. 23, 1979

[51] Int. Cl.[3] ..... G04B 37/00

[52] U.S. Cl. ..... 368/282; 368/286

[58] Field of Search ..... 150/52 R; 224/170, 173, 224/178; 368/283, 282, 285, 286, 291, 292

[56] References Cited

U.S. PATENT DOCUMENTS

| | | | |
|---|---|---|---|
| 2,182,830 | 12/1939 | Vedder | 368/281 |
| 3,492,809 | 2/1970 | Gisiger-Lusa | 368/282 |
| 3,545,198 | 12/1970 | Loftus | 368/281 |

*Primary Examiner*—Vit W. Miska

*Attorney, Agent, or Firm*—Francis X. LoJacono

[57] ABSTRACT

A cover for a wrist watch to protect the watch, watch crystal, and wrist band thereof. The watch cover comprises an elongated flexible strap member having a central opening therein, and a housing affixed to the strap member adjacent the opening. An opening in the housing is contiguously aligned with the strap opening to receive a secondary crystal therethrough, whereby the watch and watch crystal are positioned within the housing and secondary crystal, the elongated strap and housing having included thereon an ornamental sheath member defined by a decorative, soft, fabric-like material. An adjustable fastening device is mounted to the strap member so as to secure the protective watch cover around the entire wrist watch.

9 Claims, 5 Drawing Figures

FIG. 1
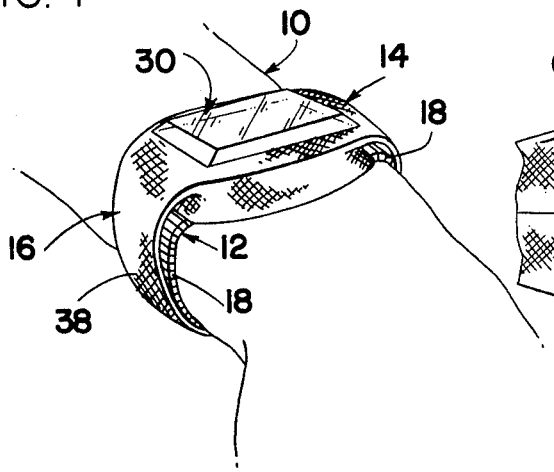
FIG. 5
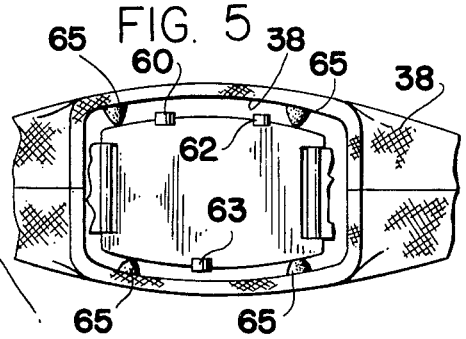
FIG. 2
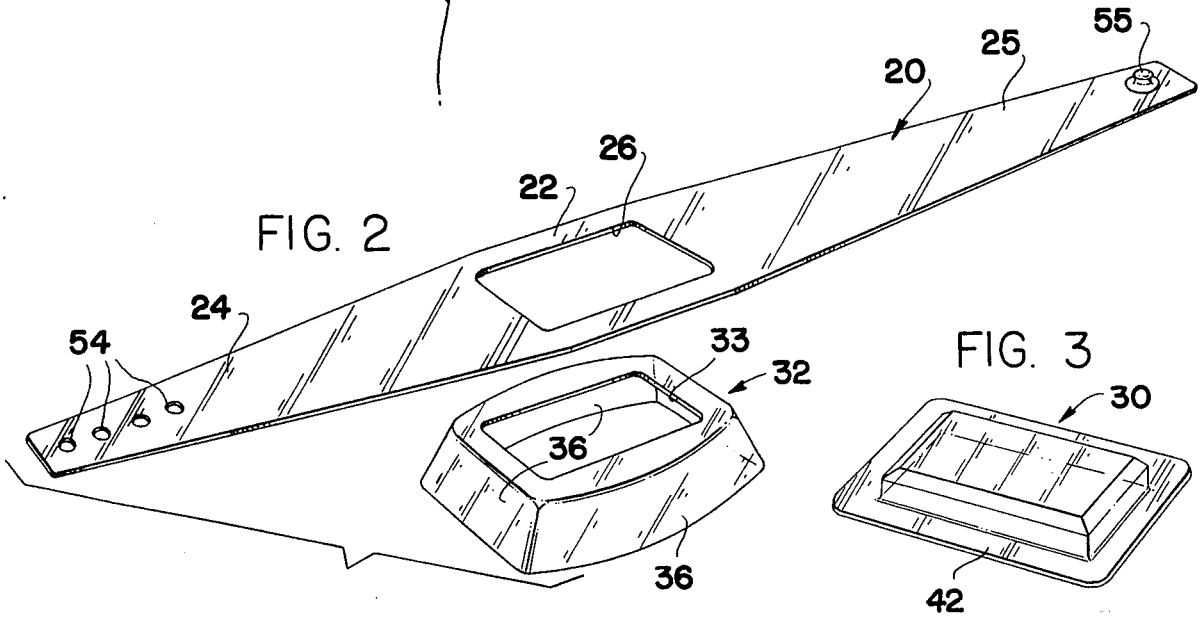
FIG. 3
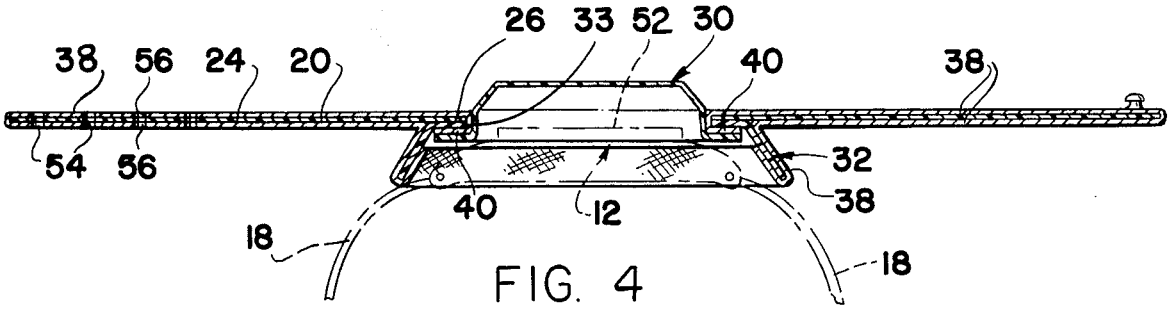
FIG. 4

PROTECTIVE WATCH COVER

BACKGROUND OF THE INVENTION

1. Field of the Invention

This invention relates to a protective watch cover, and more particularly to the combination of a protective watch cover and an ornamental sheathing constructed from a variety of materials, colors and patterns.

2. Description of the Prior Art

As is well known in the art, various problems and difficulties have been encountered in providing suitable means for protectively covering a wrist watch, particularly in those situations where a watch is to be worn under conditions that will subject it to possible abuse, causing scratching or marring.

Several types of protective devices have been tried; however, these devices have features that restrict their use. Also, they do not provide any ornamental features, whereby the cover has a decorative or pleasing appearance as well as the protective qualities.

It is a matter of common knowledge that wrist watches and their associated crystal and band members are subjected to damage or breakage, particularly when worn while working. This is also the case during activities such as dancing and athletic endeavors. Thus, there is a need for a protective device that will also serve to provide a pleasing decorative or fashionable purpose.

Some of the known devices are disclosed in the following United States patents.

U.S. Pat. No. 2,227,131 discloses a waterproof and sandproof watch protector that is especially designed to be worn by the bather, permitting him to wear a watch at the beach without the risk of water or sand coming into contact with the watch.

Another watch protector disclosed in U.S. Pat. No. 2,553,089 is a unitary structural device which is snapped on a watch and its band or strap. The device comprises a one piece formation including a shell which functions as an enclosure having arcuately bent attaching and retaining limbs.

U.S. Pat. No. 2,582,473 illustrates another transparent watch protector that is designed to cover only the top, sides and ends of the watch body.

Other United States patents of interest are U.S. Pat. Nos. 2,635,416; 2,692,070; and 3,584,455.

SUMMARY AND OBJECTS OF THE INVENTION

The present invention has for an important object to provide a protective watch cover that is not only functional but further provides a sheath having an ornamental or aesthetic value as well heretofore not provided by other such devices. A cloth like material is adapted to cover, in a sheath-like manner, the combination of structural elements comprising a flexible wrist band member having a housing affixed thereto to receive the body of the watch therein, including the watch crystal. Disposed within the housing and band member is a secondary protective crystal which allows the watch face to be clearly visible.

It is another object of the invention to provide a protective cover for wrist watches that allows the wearer thereof to substitute one design for another, depending upon the occasion or type of exposure.

It is still another object of the present invention to provide a watch cover that is styled suitably for use by both men and women, various designs and configurations being provided by inserting selected secondary crystal pieces.

It is a further object of the invention to provide a device of this character that is simple and rugged in construction, and that will have a long-lasting use.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial view of the protective watch cover mounted to a typical wrist watch that is shown secured to the wrist of a wearer thereof;

FIG. 2 is an exploded view of the cover wrist strap and the watch-cover housing prior to being assembled;

FIG. 3 is a perspective view of the secondary crystal member;

FIG. 4 is a longitudinal cross-sectional view of the protective watch cover in its completed form, having an ornamental sheath disposed thereon; and FIG. 5 is a bottom view of a watch supported within the cover housing by means of positioning members.

DESCRIPTION OF THE PREFERRED EMBODIMENT

Referring more particularly to FIG. 1, there is shown a wrist portion 10 of a hand having positioned thereon a wrist watch, generally indicated at 12, which is protectively covered by the protective watch cover designated at 14. As can be seen, the protective watch cover 14 encapsulates the main watch body —the cover strap members, indicated generally at 16, overlying the watch band 18 and thus protecting all normally exposed elements of the wrist watch itself.

The protective watch cover 14 as disclosed herein is designed to be ornamental as well as utilitarian. This will be further understood by the following description of the elements which comprise the protective cover.

Accordingly, the protective watch cover 14 comprises an elongated strap member 20 which is molded or stamped from a suitable pliable material, such as a plastic. Strap 20 may be provided with various elongated configurations, but is herein shown as having an enlarged central body 22 with diametrically outward extending strap members 24 and 25. (See FIG. 2.)

Formed within the central body portion 22 of strap 20 is an opening 26, the peripheral configuration thereof being determined by the design and configuration of the secondary protective crystal member 30, illustrated in FIG. 3.

Protective cover 14 further includes a protective housing 32 defined by an upper substantialy flat wall member 34, having an opening 33 therein, and four depending flange wall members 36, the upper wall 34 being arranged to be secured to the lower surface of strap member 20. That is, housing 32 is mounted below opening 26 of the central body 22, whereby opening 33 of housing 32 is positioned in direct alignment therewith. Any suitable means can be employed in securing housing 32 to strap 20—such as bonding, gluing or heat-welding.

After housing 32 is affixed to strap 20, the two elements 32 and 20 are covered with a soft pliable material or fabric defining an outer ornamental sheath 38. Thus, various colors and designs of cloth materials (including denim fabric) can be individually superposed over the upper and lower surfaces of strap 20 and the walls 36, so as to encapsulate the protective cover 14.

Once this is accomplished, the secondary crystal member 30 is positioned within contiguous openings 26 and 33. As seen in FIG. 4, it is preferred that the sheath material 38 be extended through the openings 26 and 33, the peripheral edges of which are overlapped at 40. Crystal 30 is glued or otherwise secured within housing 32 by means of peripheral flange 42 of crystal 30 abutting against the overlapping material 40. Thus, it should be noted that various design configurations as well as colors can be employed in forming a crystal to compliment a particular watch style. For example, the secondary crystal 30 can be square, round, oval, etc.

The example as illustrated herein is shown as being rectangular, as seen in FIG. 4, which shows a man's watch 12 in phantom lines positioned within the sheath-covered housing 32; and the primary crystal 52 of watch 12 is positioned under the secondary crystal 30.

It is contemplated that several suitable fastening means can be provided to mount and secure the protective cover 14 about the wrist watch. However, as one example, the fastening means herein shown comprises a plurality of aligned holes 54 formed in strip member 24 with a button head 55 affixed to the outer end of strip member 25. When the sheath material 38 is mounted to strap 20, holes 56 are punched therein—thus exposing holes 54, as illustrated in FIG. 4.

After watch 12 is secured to wrist 10, the protective cover is mounted thereover; the secondary crystal is mounted over the primary crystal; and the strap ends are then wrapped around the watch hand 18 and fastened in place.

Referring to FIG. 5, there is shown a watch 12 having a plurality of well known means for setting the time, the day, and the date. Such means are indicated by pins 60, 62 and 63, respectively. In order to prevent the accidental pressing of any one of these pins, a central positioning means is required. The central positioning means comprises a plurality of pliable bumper members 65. These bumper members may be positioned within housing 32 and suitably secured so as to hold watch 12 away from the side walls 36 of housing 32, whereby pins 60, 62 and 63 are prevented from engaging housing 32.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A protective watch cover for wrist watches, comprising:

an elongated strap member having a central body portion including a central opening disposed therein;

a housing defined by an upper substantially flat wall and depending flange wall members, said flat wall having a central opening therein disposed to be contiguously aligned with said opening in said strap member when said strap and said housing are secured together, said housing being adapted to receive a watch therein;

a secondary crystal member adapted to be received in said contiguous openings and having the same peripheral configuration as said openings, said crystal being affixed within said housing;

an ornamental sheathing arranged to encapsulate said housing, and said elongated strap throughout its length; and fastening means mounted to said elongated strap member, so as to hold said watch cover in place about said wrist watch.

2. A protective watch cover as recited in claim 1, wherein said ornamental sheathing comprises a soft pliable material.

3. A protective watch cover as recited in claim 2, wherein the sheath material comprises a fabric having selective colors and patterns.

4. A protective watch cover as recited in claim 2, wherein the sheath material comprises a denim fabric.

5. A protective watch cover as recited in claim 1, wherein said housing includes means for centrally positioning the watch within said housing.

6. A protective watch cover as recited in claim 5, wherein said means for centrally positioning said watch comprises a plurality of projecting bumper members affixed to the side walls of said housing.

7. A method of forming a protective cover for wrist watches, comprising the steps of:

forming an elongated strap member having a central body and oppositely extending strap members;

forming a central opening having a selective configuration within said central body;

affixing a housing having a central opening therein, whereby said housing opening is contiguously aligned with said strap opening;

securing a secondary crystal member within said contiguous openings;

forming said secondary crystal member so that it has a matching peripheral configuration of said contiguous openings; and encapsulating said elongated strap and said housing within an ornamental sheathing of soft pliable material.

8. A method as recited in claim 7, wherein said material is a cloth fabric.

9. A method as recited in claim 8, including the steps of providing selective cloth colors and patterns to establish various ornamental design configurations.

* * * * *